United States Patent [19]

Merkel

[11] Patent Number: 4,993,341

[45] Date of Patent: Feb. 19, 1991

[54] CONTROLLABLE GANGPLANK FOR PONTOON BOAT

[76] Inventor: Don C. Merkel, P.O. Box 207, Perryton, Tex. 79070

[21] Appl. No.: 469,211

[22] Filed: Jan. 24, 1990

[51] Int. Cl.[5] ..... B63B 27/14

[52] U.S. Cl. ..... 114/61; 14/71.1; 114/362

[58] Field of Search ..... 440/11; 14/71.1; 114/60, 61, 343, 344, 362

[56] References Cited

U.S. PATENT DOCUMENTS

| | | | |
|---|---|---|---|
| 3,483,838 | 12/1969 | Rath | 114/60 |
| 4,011,615 | 3/1977 | Maxson et al. | 14/71.1 |
| 4,293,967 | 10/1981 | Ord | 9/1.6 |

*Primary Examiner*—Sherman Basinger

*Attorney, Agent, or Firm*—Laney, Dougherty, Hessin & Beavers

[57] ABSTRACT

A gangplank for forward fixture on a pontoon barge consisting of a retaining slide structure secured longitudinally beneath the barge deck with a gangplank slidably carried therein, and an electric cable drive system controllable to move the gangplank reciprocally forward from beneath the barge.

6 Claims, 2 Drawing Sheets

CONTROLLABLE GANGPLANK FOR PONTOON BOAT

BACKGROUND OF THE INVENTION

1. Field of the Invention.

The invention relates generally to gangplanks for pleasure craft and, more particularly, but not by way of limitation, it relates to an improved form of extendable gangplank for use in combination with a pontoon-type barge or boat.

2. Description of the Prior Art.

The prior art includes numerous types of gangway and other boarding structure for use with both small and large water craft, some of which are quite old in the art. U.S. Pat. No. 4,011,615 discloses a bow gangplank of considerably different structure and intended for different usage. This patent teaches a gangplank that is intended for offshore oil rig usage when encountering considerable wave action, and it employs a spring-loaded body that will elongate and shorten in accordance with wave inducements. The gangplank itself is not controllable from the boat but must be manipulated and maintained in position between the rig platform and docking vessel. U.S. Pat. No. 4,293,967 discloses a boat with a flip-over bow gangplank wherein the gangplank in the stowed position is compactly maintained in trim against the bow form of the vessel. In docking, the gangplank is simply swung up and over to extend forward of the vessel onto a docking structure.

SUMMARY OF THE INVENTION

The present invention relates to improvements in small craft docking or landing facilities which improvements are largely directed to an on-board gangplank that is controllable for forward movement and bow docking of a barge structure. In particular, a pontoon-type of water craft is adapted to have an extensible gangplank carried between the pontoons and beneath the main deck so that an electrically driven cable can be controlled from on board the pontoon boat to extend or retract the gangplank to a dock or shore position.

Therefore, it is an object of the present invention to provide an extendable gangplank for use with pontoon-type boats.

It is also an object of the present invention to provide a safe and reliable gangplank device that can be readily landed as controlled from the pontoon vessel.

It is yet further an object of the present invention to provide a retractable gangplank device for pontoon boats that is economical, yet simple and reliable in structure.

Finally, it is an object of the invention to provide an extendable gangplank that may be controlled using the d-c power supply of the pontoon boat.

Other objects and advantages of the invention will be evident from the following detailed description when read in conjunction with the accompanying drawings which illustrate the invention.

DETAILED DESCRIPTION OF THE INVENTION

Figure 1:
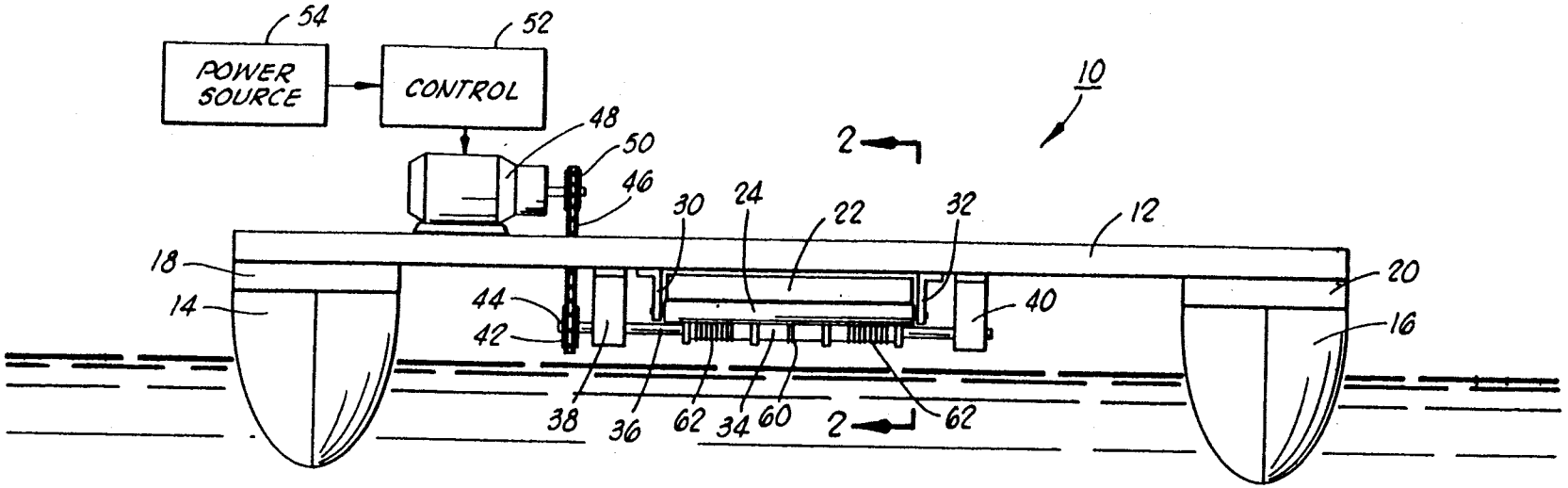
FIG. 1 is a front view in elevation of a pontoon boat constructed in accordance with the invention.

Referring to FIG. 1, a pontoon boat 10 in its simplest form consists of a main platform or deck 12 supported on each side by flotation members or pontoons 14 and 16. The main deck 12 may be of various sizes and dimensions, and it may be constructed of wood, steel or the like in any of various construction modes. The pontoon structures 14 and 16 are commonly formed as watertight aluminum structures; however, it is also quite common to use a plastic flotation material covered with a skin of such as fiberglass. The pontoons 14 and 16 may be rigidly secured to the main deck 12 by means of respective mounting plates 18 and 20.

Figure 2:
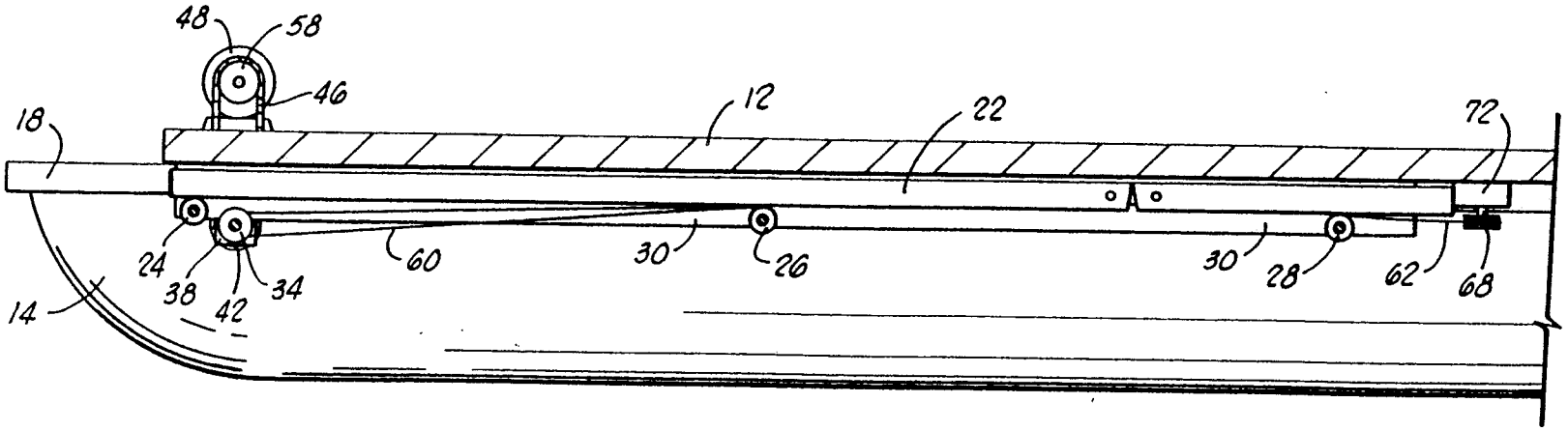
FIG. 2 is a partial section taken along lines 2-2 of FIG. 1.

Referring also to FIG. 2, a gangplank 22 is slidably mounted centrally and beneath main deck 12 for forward and rearward movement. The gangplank 22 is movably supported on a plurality of rollers 24, 26 and 28 which are journaled for rotatable movement between opposite side angle braces 30 and 32 as secured to the underside of main deck 12.

Longitudinal movement of gangplank 22 is under control of a cable assembly, as will be further described, that is wound on a drum 34 supported on an axle 36 that is journaled for rotation within opposite side pillow blocks 38 and 40. A sprocket 42 rigidly secured to an end 44 of axle 36 is driven by a drive chain 46 receiving drive input from a motor 48 and drive sprocket 50. A suitable clearance (not shown) is provided through main deck 12 for passage of the two falls of drive chain 46.

The electric motor 48 may be any suitable bi-directional d-c motor and it may include integral step-down gear reduction, as is commercially available. Motor 48 may be controlled as to bi-directional rotation by a switch control 52 receiving energy from power source 54, e.g., the shipboard power battery.

Figure 3:
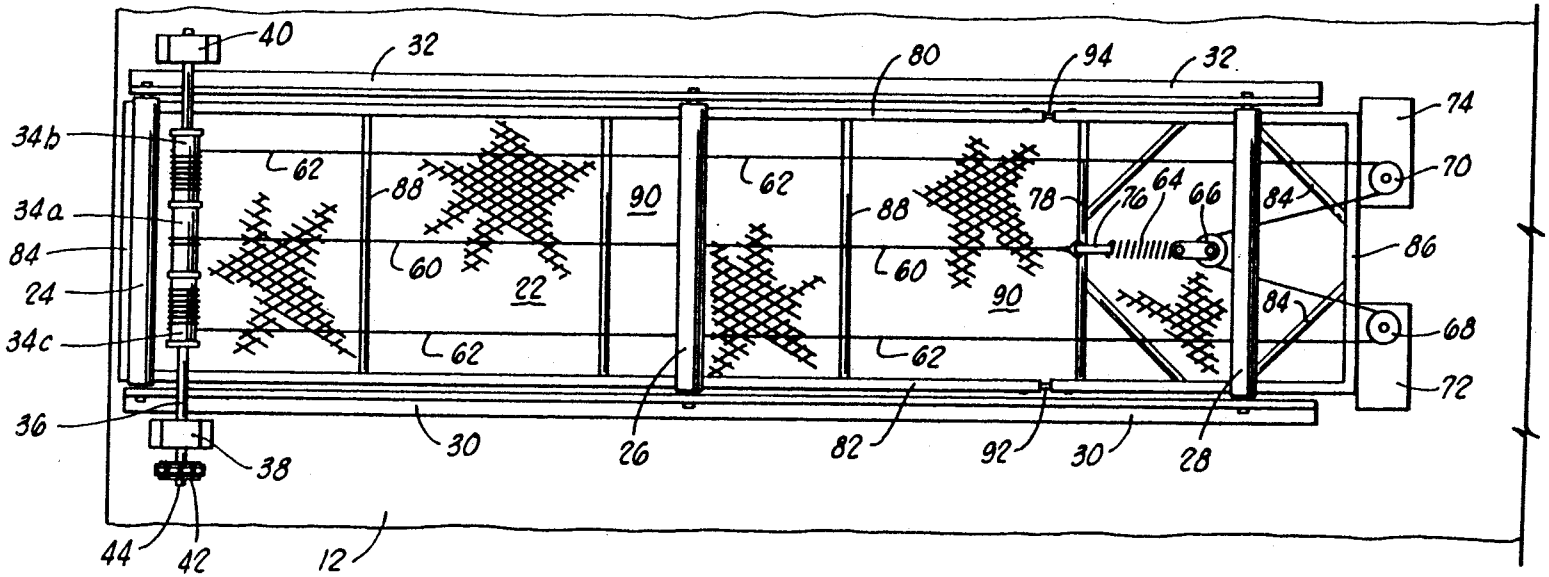
FIG. 3 is a bottom plan view of a part of the pontoon boat deck illustrating the slidable gangplank and cable control assembly.

Referring also to FIG. 3, the gangplank 22 is bi-directionally controlled in movement by an outboard cable 60 (center) and inboard cable 62. The cables may be nylon, plastic coated steel or similar water-resistant types. The outboard cable 60 is wound about a center drum way 34*a* and led rearward for affixure to mounting bracket 76. A heavy duty spring 64 connected to an idler pulley 66 is also connected to bracket 76. The opposite side falls of inboard cable 62 ar each oppositely wound from cable 60 around the outer drum ways 34*b* and 34*c* and led rearward whereupon each fall is wound rearwardly around a respective pulley 68 and 70 as supported by respective limit blocks 72 and 74. From pulleys 6S and 70 the cable 62 is then controlled by forward pass over idler pulley 66. The cable 60 as well as the shock absorbing spring 64 are secured to the mounting bracket 76 which is secured as by welding to gangplank cross brace 78.

Thus, it can be seen that counterclockwise revolution of control drum 34 (viewing from sprocket 42) will tend to spool-up the cable 60 while drawing the tow bracket 76 and gangplank 22 forward for contact with a shore surface. Alternatively, to draw in the gangplank 22, the drum 34 is reversed for clockwise movement (again viewing from sprocket 42) whereupon cable falls 62 each spool-up while cable 60 unspools and gangplank 22 is withdrawn to its inward position as shown in FIG. 3. The gangplank may be readily controlled from the driver's position onboard the pontoon boat and he can easily extend or withdraw gangplank 22 when proximate the shoreline or other docking surface with minimum distraction from navigation activity.

Figure 4:
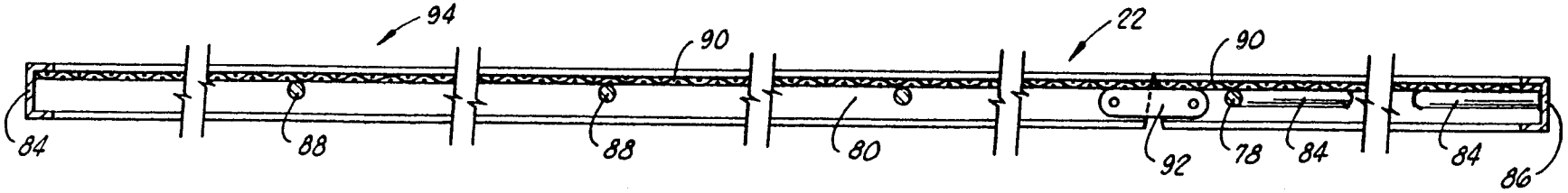
FIG. 4 is a vertical section taken longitudinally of the gangplank.

FIG. 4 shows the gangplank 22 in vertical section as it consists of a rectangular frame of metal channel members (see also FIG. 3) side channels 80 and 82, and opposite end channels 84 and 86. Transverse braces 88 may be placed between side channels 80 and 82 as needed, and one or more corner braces 84 may be welded in place. A tread surface 90 of expanded metal or the like may be placed within the channel frame and welded to provide secure footing. It is preferable that the gangplank and supporting structure be constructed of non-rusting, low corrosion metals, e.g., aluminum; however, it is contemplated that certain components may well be formed of plastic.

Hinge sections 92 and 94 are provided at similar positions in each of side channels 80 and 82 in order to provide some limited vertical movement to the outer end of gangplank 22. Thus, when gangplank 22 is extended a sufficient amount, where hinges 94 and 92 are forward over the front roller 24, the front gangplank section 94 is free to drop downward until it contacts a supporting structure.

The foregoing discloses a novel gangplank structure that is particularly useful in small pontoon boat operations to allow the boat operator easy control of extension and withdrawal of the gangplank while still attending to the steering and throttle control. The gangplank is stowed in a non-interfering position beneath the main deck and between the lateral pontoons, and a simple d-c electrical control system located topside provides quick and reliable extension and retraction of the gangplank from a low position. Such adjustable forward gangplank enables the pontoon boat to make landings at more varied shoreline surfaces or dock areas while avoiding the possibility of damage to the front edge of the pontoons; that is, to avoid beaching the pontoons in order to get close enough to step off of the main deck.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. An extendable gangplank for a pontoon boat having a main deck portion and spaced lateral pontoons, comprising:

parallel spaced guide means secured longitudinally to the under side of the main deck portion between said pontoons;

a gangplank having front and rear ends and being slidably retained by said guide means to extend forward of the pontoon boat;

reversible drive means including a rotatable drum positioned transverse the boat and proximate the bow underside the main deck portion, said drum being selectively controlled to effect forward and reverse rotation;

a first cable wound on said drum and extending rearward for connection to said gangplank rear end;

a second cable having first and second ends oppositely wound on said drum and extending rearward around a pulley support disposed adjacent the gangplank rear end;

idler pulley means secured to the rear end of said gangplank and receiving the second cable forward thereover; and control means operable from the main deck portion to control selectively said drive means to rotate the drum with the first cable winding up and the second cable unwinding to position the gangplank forward of the main deck portion, and to rotate the drum in the opposite direction with the first cable unwinding and the second cable winding up to position the gangplank withdrawn and beneath the main deck portion.

2. A retractable gangplank as set forth in claim 1 wherein said drive means comprises:

a d-c power source;

a d-c electric motor with chain drive sprocket mounted on the main deck portion;

a sprocket secured to rotate said drum; and an endless chain extending through the main deck portion and connecting over said drive sprocket and sprocket.

3. A retractable gangplank as set forth in claim 1 wherein the second cable pulley support comprises:

a spring-mount supporting said idler pulley and secured to said gangplank rear end; and first and second idler pulleys mounted rearward and on opposite sides of said spring-mounted idler pulley and each receiving the second cable rearward thereover.

4. A retractable gangplank as set forth in claim 3 wherein said drive means comprises:

a d-c power source;

a d-c electric motor with chain drive sprocket mounted on the main deck portion;

a sprocket secured to rotate said drum; and an endless chain extending through the main deck portion and connecting over said drive sprocket and sprocket.

5. A retractable gangplank as set forth in claim 1 wherein said gangplank further comprises:

an elongated, rectangular channel frame;

a decking material secured within said channel frame;

at least one transverse support rod connected across said frame beneath said decking material; and hinge means disposed in the channel frame to allow limited movement of the forward part of the gangplank.

6. A retractable gangplank as set forth in claim 5 wherein:

said gangplank frame is constructed from aluminum and said decking material is expanded aluminum sheeting.

* * * * *